US006457215B1

(12) United States Patent
Martin

(10) Patent No.: US 6,457,215 B1
(45) Date of Patent: Oct. 1, 2002

(54) BRACELET CLASP

(75) Inventor: Philippe Martin, Le Russey (FR)

(73) Assignee: Cartier International B.V., Amsterdam (NL)

( * ) Notice: Subject to any disclaimer, the term of this patent is extended or adjusted under 35 U.S.C. 154(b) by 0 days.

(21) Appl. No.: 09/744,198

(22) PCT Filed: May 8, 2000

(86) PCT No.: PCT/IB00/00586 Jan. 22, 2001

§ 102(e) Date: Jan. 22, 2001

(87) PCT Pub. No.: WO00/72094

PCT Pub. Date: Nov. 30, 2000

(30) Foreign Application Priority Data

May 21, 1999 (FR) ..... 99 110026

(51) Int. Cl.[7] ..... A44C 5/20

(52) U.S. Cl. ..... 24/265 WS; 24/265 EC; 24/68 J; 24/316; 63/3; 63/12

(58) Field of Search ..... 24/265 WS, 265 BC, 24/265 EC, 265 R, 265 H, 68 J, 69 J, 70 J, 71 J, 69 R, 316, 327; 65/3.1, 1.11, 12, 14.4

(56) References Cited

U.S. PATENT DOCUMENTS

| | | | | |
|---|---|---|---|---|
| 2,954,622 A | | 10/1960 | Moore | |
| RE26,584 E | * | 5/1969 | Spence | 24/316 |
| 3,665,565 A | * | 5/1972 | Kruger | 24/265 WS |
| 4,414,714 A | * | 11/1983 | Kostanecki et al. | 224/175 |
| 4,539,736 A | * | 9/1985 | Yokosuka | 24/265 WS |
| 4,679,280 A | * | 7/1987 | Krahenbuhl | 24/599.6 |
| 5,042,115 A | * | 8/1991 | Dumas et al. | 24/180 |
| 5,689,861 A | * | 11/1997 | Petignat | 24/265 B |
| 6,073,316 A | * | 6/2000 | Ferrario et al. | 24/71 J |
| 6,112,373 A | * | 9/2000 | Steinhauer et al. | 24/615 |
| 6,130,862 A | * | 10/2000 | Upton | 368/282 |

FOREIGN PATENT DOCUMENTS

| | | |
|---|---|---|
| CH | 404 268 | 6/1966 |
| FR | 935 435 | 6/1948 |

* cited by examiner

*Primary Examiner*—Robert J. Sandy
*Assistant Examiner*—André Jackson
(74) *Attorney, Agent, or Firm*—Young & Thompson

(57) ABSTRACT

A clasp for bracelet comprising a body whereof one of the sides is fixed to or integral with one of the ends of the bracelet and whereof the opposite side comprises a retaining element cooperating with a coupling member comprised by the other end of the bracelet. A cover is articulated on the clasp body so that it can move relative to the clasp body transversely with respect thereto and to the axis of the bracelet and pivot about a hinge pin parallel to the axis of the bracelet.

8 Claims, 6 Drawing Sheets

B-B

C-C

E-E

D-D

BRACELET CLASP

CROSS REFERENCE TO RELATED APPLICATION

This application is the 35 USC 371 national stage of International Application PCT/IB00/00586 filed on May 8, 2000, which designated the United States of America.

FIELD OF THE INVENTION

The present invention has for its object a clasp called a "secret clasp" for a bracelet, more particularly for a rigid bracelet, whether the bracelet be for jewelry or a watch bracelet for example.

As its name indicates, the clasp which is the object of the invention must be the least visible possible, integrated as it is as an element of the bracelet, whilst ensuring a certain closure of the bracelet that cannot open accidentally.

BACKGROUND OF THE INVENTION

There is known from FR 935435 a flexible or articulated bracelet clasp comprising a base plate to which one of the ends of the bracelet is permanently fixed whilst the other end of the bracelet can be fixed removably with the aid of hooks. A cover articulated on this base plate covers in the service position the hooks and prevents opening the bracelet.

Such a clasp has the drawback of not having sufficient safety, locking of the cover on the base being haphazard and above all not constituting a secret clasp because it is immediately recognizable as being a clasp at first glance.

SUMMARY OF THE INVENTION

The present invention has for its object the provision of a secret clasp, hence almost invisible, for a rigid bracelet preventing any accidental or involuntary opening.

The secret clasp for a rigid bracelet according to the present invention is distinguished by the characteristics set forth in claim 1.

BRIEF DESCRIPTION OF THE DRAWINGS

The accompanying drawing shows schematically and by way of example an embodiment of the secret clasp according to the invention, applied to a watch bracelet.

DETAILED DESCRIPTION OF THE INVENTION

Figure 1:
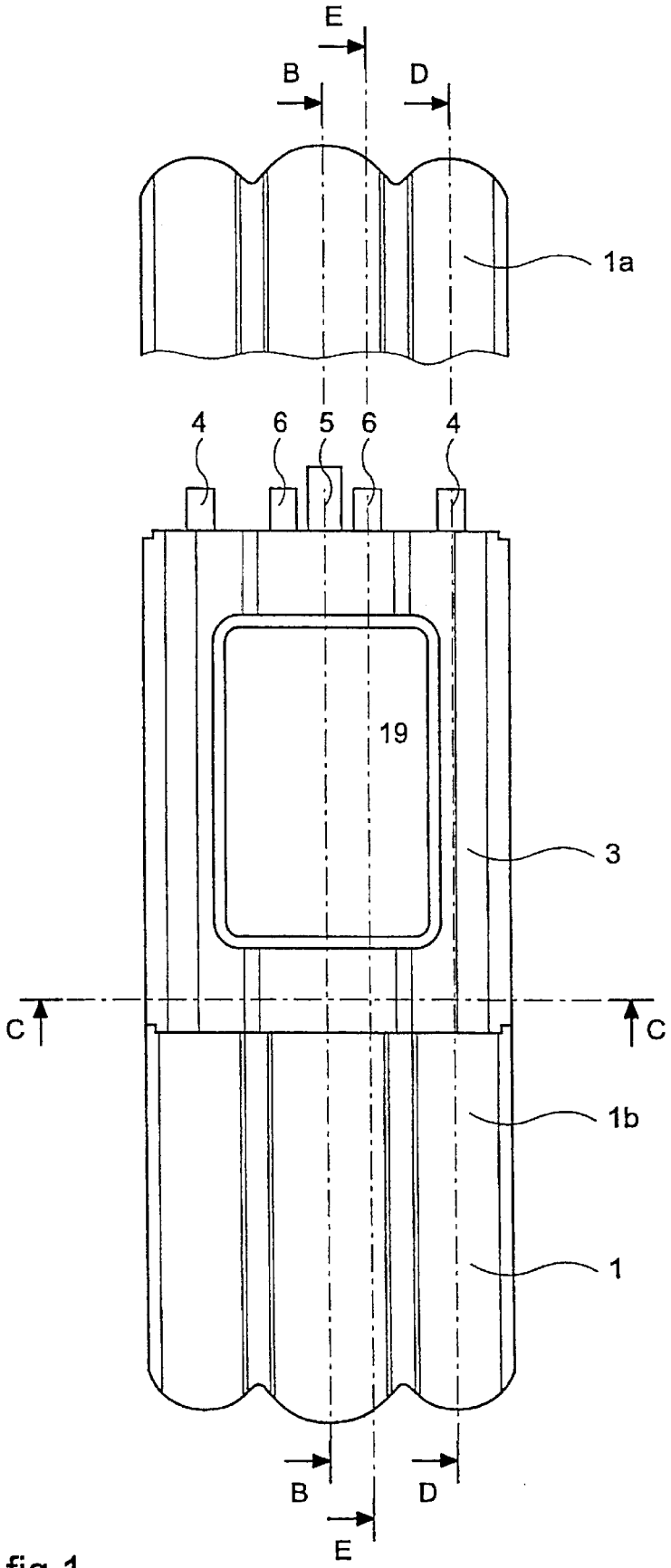
FIG. 1 is a plan view of the watch bracelet provided with the clasp according to the invention.
Figure 2:
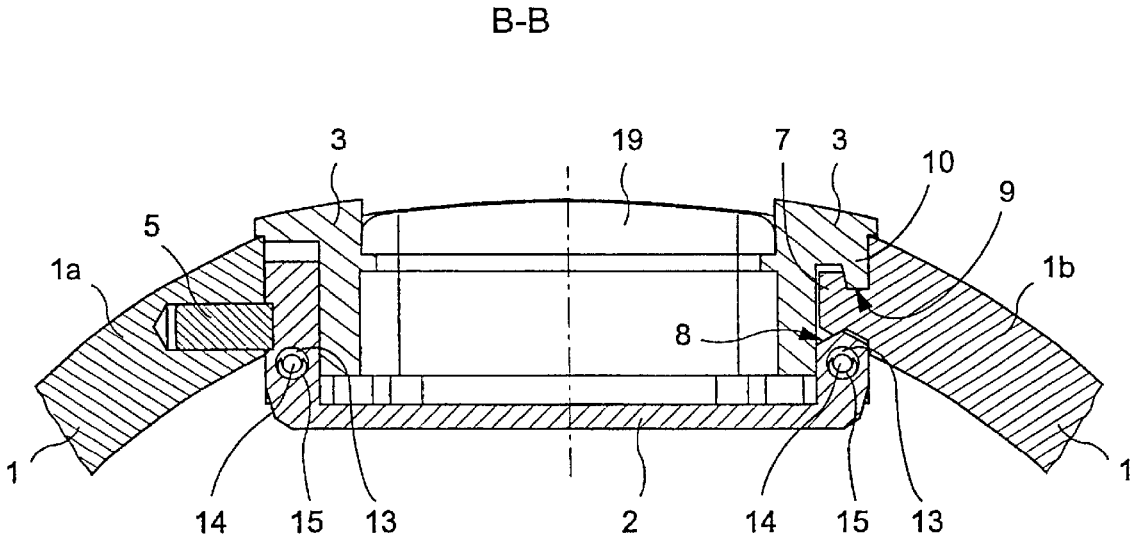
FIG. 2 is a cross section on the line B—B of FIG. 1.
Figure 3:
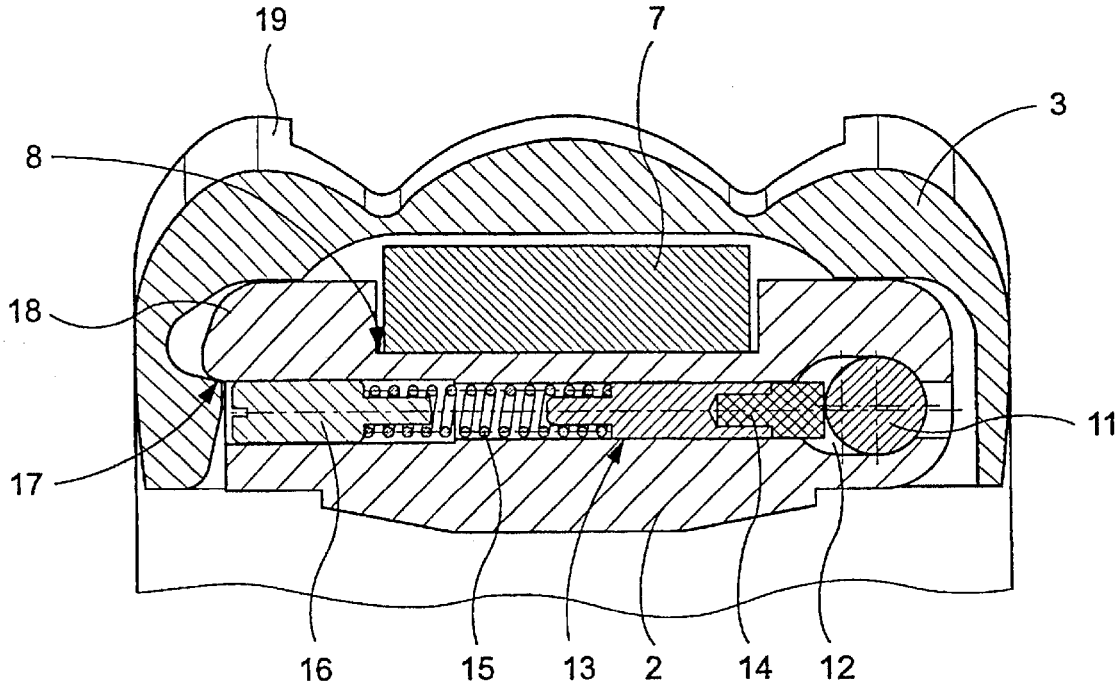
FIG. 3 is a cross section on the line C—C of FIG. 1.
Figure 4:
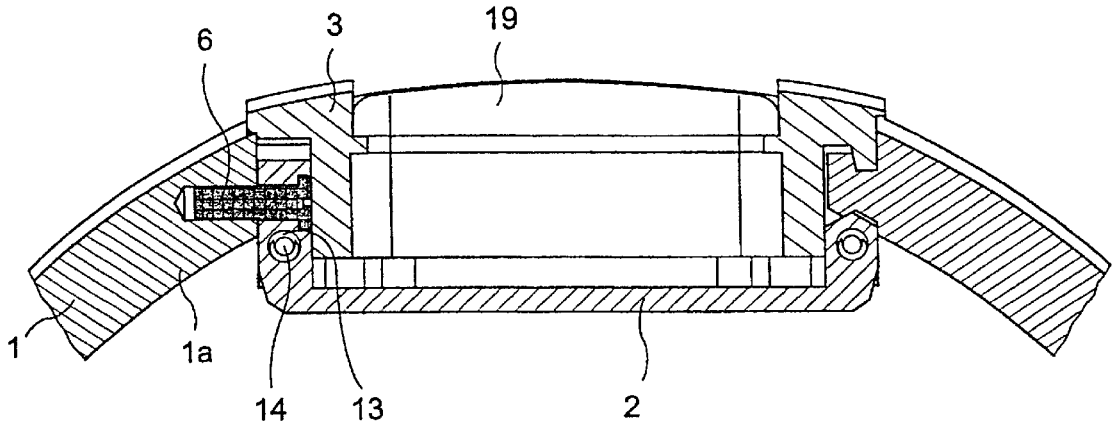
FIG. 4 is a cross section on the line E—E of FIG. 1.
Figure 5:
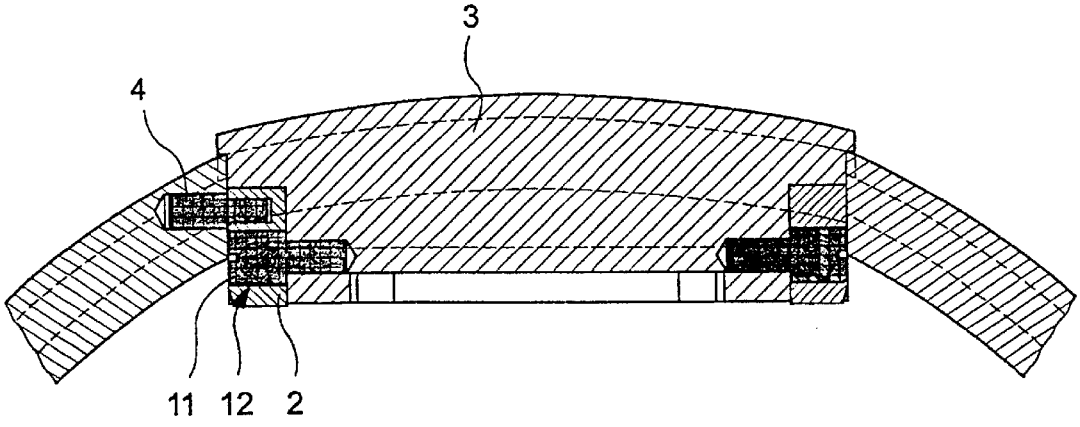
FIG. 5 is a cross section on the line D—D of FIG. 1.
Figure 6:
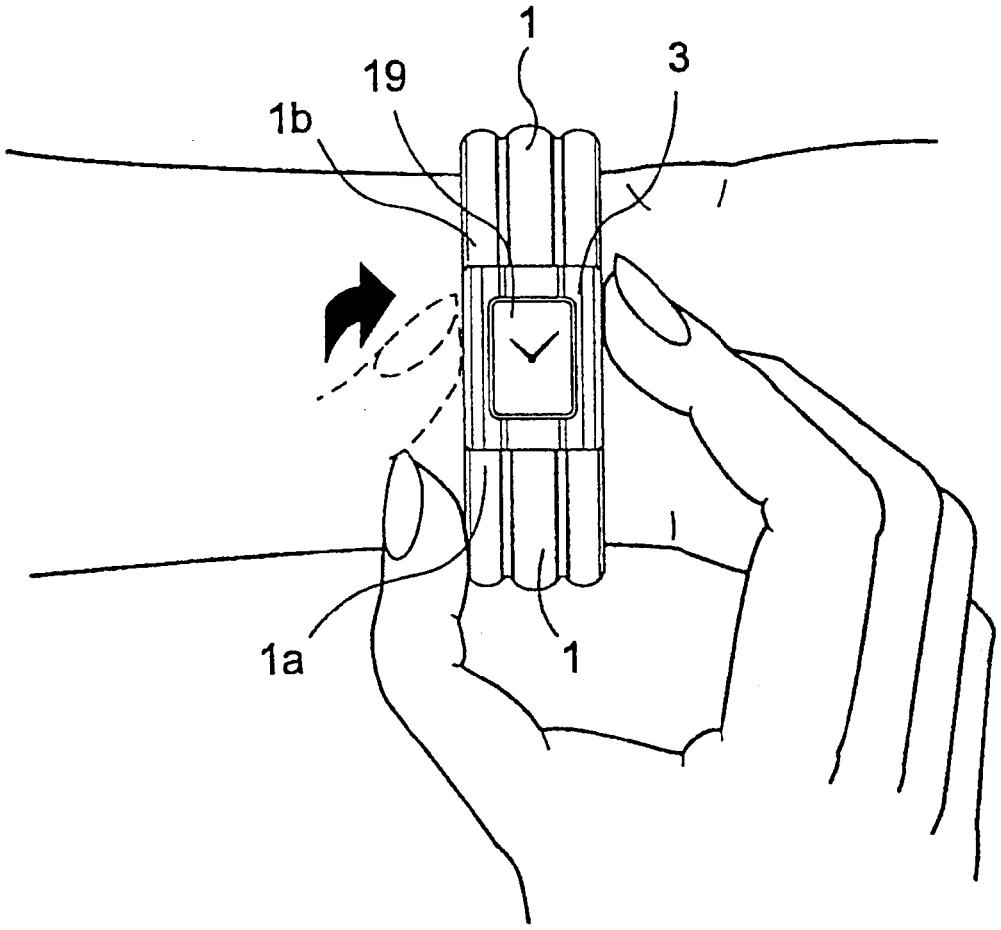
FIG. 6 shows the watch bracelet on the user's wrist.

With reference to FIGS. 1 to 5, there will now be described by way of example a rigid watch bracelet provided with the secret clasp according to the invention.

The rigid bracelet 1 comprises two ends, one end, 1*a*, is fixed rigidly and permanently to the secret clasp and the other end 1*b* is adapted to be removably fixed to the other side of the secret clasp.

The secret clasp comprises body 2 and a cover 3 articulated on this body 2. The body 2 of the secret clasp is arranged in this embodiment to receive a watch casing whose dial is visible through an opening of the cover 3 of the secret clasp.

The end 1*a* of the rigid bracelet, which is sufficiently resilient to permit its enlargement during opening for the passage of the hand of the user, is fixed on one side of the body 2 of the clasp. This securement is realized in the illustrated example with two positioning pins 4, 5 and two screws 6.

The other end 1*b* of the rigid bracelet comprises a coupling member 7 which can, as will be seen later, be locked temporarily on the other side of the secret clasp.

The side of the body 2 of the secret clasp opposite that rigidly connected to the bracelet 1 comprises a locking ridge 8 coacting in the closed position of the bracelet with the lower surface of the coupling member 7. The upper portion of the end 1*b* of the bracelet comprises a locking groove 9, located behind the coupling member 7, and adapted to receive a locking rib 10 which is carried by the cover 3 of the secret clasp.

Thus, when bracelet 1 is closed, its end 1*b* is maintained locked between the body 2 and the cover 3 of the clasp. To open the bracelet, it is necessary to open, that is to say to pivot, the cover 3 of the clasp on its body 2.

The cover 3 of the secret clasp is pivoted on the body 2 of this clasp with two cylindrical-headed screws 11, screwed into two opposite sides of the cover 3 and whose heads are disposed in slots 12 or oval holes of the body 2 of the clasp.

The cylindrical heads of these screws 11 are subjected to a resilient action tending to press them against the adjacent end of the slot 12 of the lateral edge of the body 2 of the clasp. To this end, the body comprises passages 13 in which slide pushers 14 subject to the action of a spring 15 itself positioned by a screw 16 screwed into the body 2.

These resilient devices 13–16 have two functions, the first to maintain the pivot screws 11 against the corresponding end of the slot 12 and the second to give to the screws 11 a certain friction.

The edge of the cover 3 opposite the screws 11 forming its articulation, is provided with a retaining nose 17 coacting with the edge 18 of the body 2.

Thus, in the illustrated closed position of the clasp, the cover is maintained in its locking position of the bracelet by this retaining nose, and the action of the resilient devices 14–16.

In this closed position of the cover, the coupling member 7 of the end 1*b* of the bracelet 1 is locked between the body 18 and the cover 3, 10 of the clasp.

Figure 7:
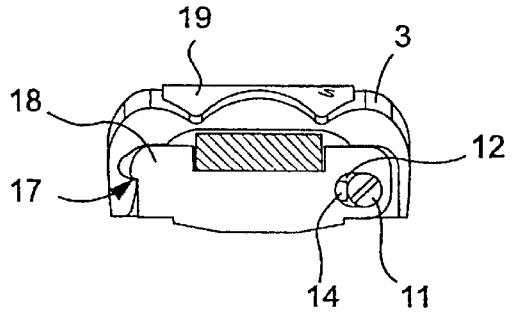
FIGS. 7 to 10 show the different operative positions of the clasp during its opening.
Figure 8:
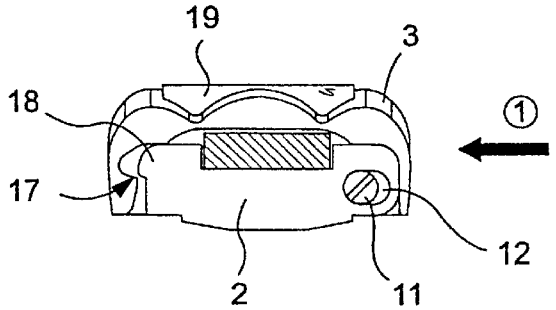
Figure 9:
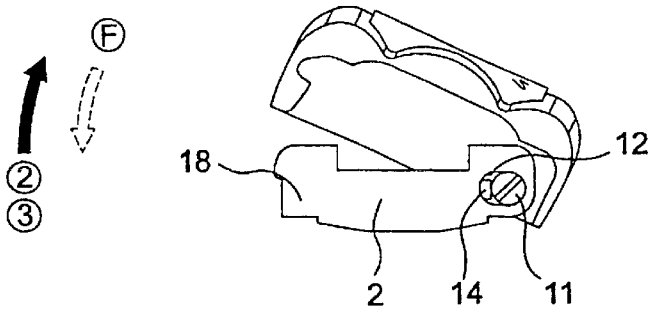
Figure 10:
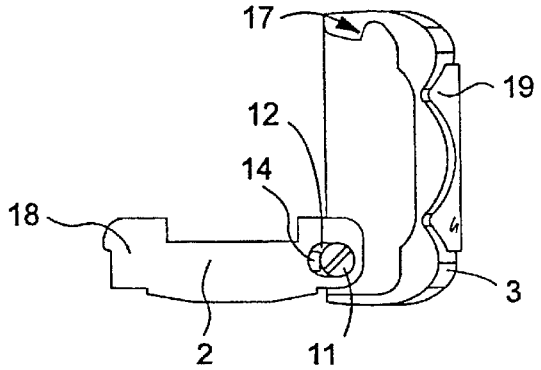

To open the bracelet, it is-necessary deliberately to carry out two movements of the cover 3 of the clasp relative to the body 2 of the latter. It is necessary in the first instance to press the cover 3 transversely from its position shown in FIG. 7 to the position shown in FIG. 8 to free the nose 11 from the edge 2, then to pivot the cover 3 against the friction exerted by the resilient means 14–16 on the screws 11. Only when the cover 3 is totally open (FIG. 10), can the user withdraw the end 1*b* of the bracelet 1 from the clasp 2, 3, thereby opening the bracelet, which because of its flexibility permits the user to withdraw his hand from the bracelet.

In the illustrated case, the cover 3 of the clasp comprises a crystal 19 permitting seeing the watch disposed in the clasp.

In other embodiments, the clasp need not comprise a watch and the cover 3 of the clasp is solid or can comprise a decoration or serve to support set stones.

The safety of the clasp is total, because two movements are required in different directions, a translation followed by a rotation of the cover 3 relative to the body 2 of the clasp, to open the clasp. The screws 11 of the resilient devices 14–16 permit adjusting the friction applied to the pivot screws 11 of the cover. Thus the cover, even if moved transversely to free the nose 17, cannot move angularly except at the will of the user.

This secret clasp is thus safe and reliable. Moreover, it is integrated into the bracelet and is practically invisible, whether the bracelet be a jewelry plate bracelet or a watch bracelet.

To increase the resistance to pivoting of the cover 3, the head of the screws 11 can comprise a flat which coacts with the corresponding pusher 14 in the closed position of the clasp.

What is claimed is:

1. A bracelet clasp, comprising a body having two ends and two sides, one of the sides being fixed or secured to one of the ends of the bracelet, and the opposite side comprising a retaining formation coacting with a coupling member on the other end of the bracelet; a cover articulated on the body of the clasp so as to be movable relative to the body of the clasp transversely relative to the body and to an axis of the bracelet, and also to be able to pivot about a hinge axis of articulation parallel to the bracelet axis; said body being structured and arranged to receive a watch casing, and said cover comprising an opening exposing a dial of said watch.

2. The clasp according to claim 1, wherein the cover of the clasp is provided with pivot screws whose head coacts with slots in the body of the clasp, and the pivot screws are subjected to action by of resilient devices mounted in the body of the clasp tending to move the pivot screws outwardly of the clasp.

3. The clasp according to claim 2, wherein each resilient device comprises, located in a transverse hole in the body of the clasp, a pusher, a spring and a screw screwed into the hole in the body, permitting pressure adjustment of the pusher on the pivot screws.

4. The clasp according to claim 3, wherein an edge of the cover opposite the pivot screws comprises a nose coacting with an edge of the clasp body to maintain the cover in closed position on the body.

5. The clasp according to claim 4, wherein the cover comprises a locking rib coacting in a closed position of the covers on the body of the clasp, with the coupling member at the other end of the bracelet.

6. The clasp according to claim 2, wherein an edge of the cover opposite the pivot screws comprises a nose coacting with an edge of the clasp body to maintain the cover in closed position on the body.

7. The clasp according to claim 6, wherein the cover comprises a locking rib coacting in a closed position of the covers on the body of the clasp, with the coupling member at the other end of the bracelet.

8. The clasp according to claim 6, wherein to open the cover, the cover must first be moved transversely relative to the body to free the retaining nose, and then pivoted about the hinge axis formed by the pivot screws against friction surfaces created by the resilient devices on the pivot screws.

* * * * *